US007663591B2

(12) United States Patent
Sasaki et al.

(10) Patent No.: US 7,663,591 B2
(45) Date of Patent: Feb. 16, 2010

(54) DISPLAY DEVICE AND METHOD OF DRIVING SAME

(75) Inventors: Takashi Sasaki, Mie (JP); Tai Shiraishi, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 972 days.

(21) Appl. No.: 10/990,381

(22) Filed: Nov. 18, 2004

(65) Prior Publication Data

US 2005/0110733 A1 May 26, 2005

(30) Foreign Application Priority Data

Nov. 25, 2003 (JP) ..... 2003-393805
Oct. 25, 2004 (JP) ..... 2004-310073

(51) Int. Cl.
*G09G 3/36* (2006.01)

(52) U.S. Cl. ..... 345/100; 345/87

(58) Field of Classification Search ..... 345/87–103
See application file for complete search history.

(56) References Cited

U.S. PATENT DOCUMENTS 6,020,874 A 2/2000 Kurihara
6,121,941 A 9/2000 Hirtz
2001/0022581 A1* 9/2001 Koyama et al. ..... 345/204
2002/0176030 A1* 11/2002 Matsumoto ..... 349/43
2003/0011581 A1 1/2003 Tanaka et al.

FOREIGN PATENT DOCUMENTS

| | | |
|---|---|---|
| JP | 05-035221 | 2/1993 |
| JP | 05-143024 | 6/1993 |
| JP | 08-234698 | 9/1996 |
| JP | 09-050264 | 2/1997 |
| JP | 10-105107 | 4/1998 |
| JP | 2003-58133 | 2/2003 |
| JP | 2003-186416 | 7/2003 |

* cited by examiner

*Primary Examiner*—Amare Mengistu
*Assistant Examiner*—Jennifer Zubajlo
(74) *Attorney, Agent, or Firm*—Harness, Dickey & Pierce P.L.C.

(57) ABSTRACT

A display device is made up of (i) a source driver made up of source driver ICs each driving an identical number of data signal lines, the source driver ICs being grouped into at least a first individually-driven circuit group and a second individually-driven circuit group, and (ii) a control circuit that outputs a first start pulse and a first latch pulse for controlling the first individually-driven circuit group and a second start pulse and a second latch pulse for the second individually-driven circuit group. With this, it is possible to provide the display device that can reproduce images without adopting complicated circuitry and elongating one horizontal period, when the source driver has dummy signal lines.

32 Claims, 15 Drawing Sheets

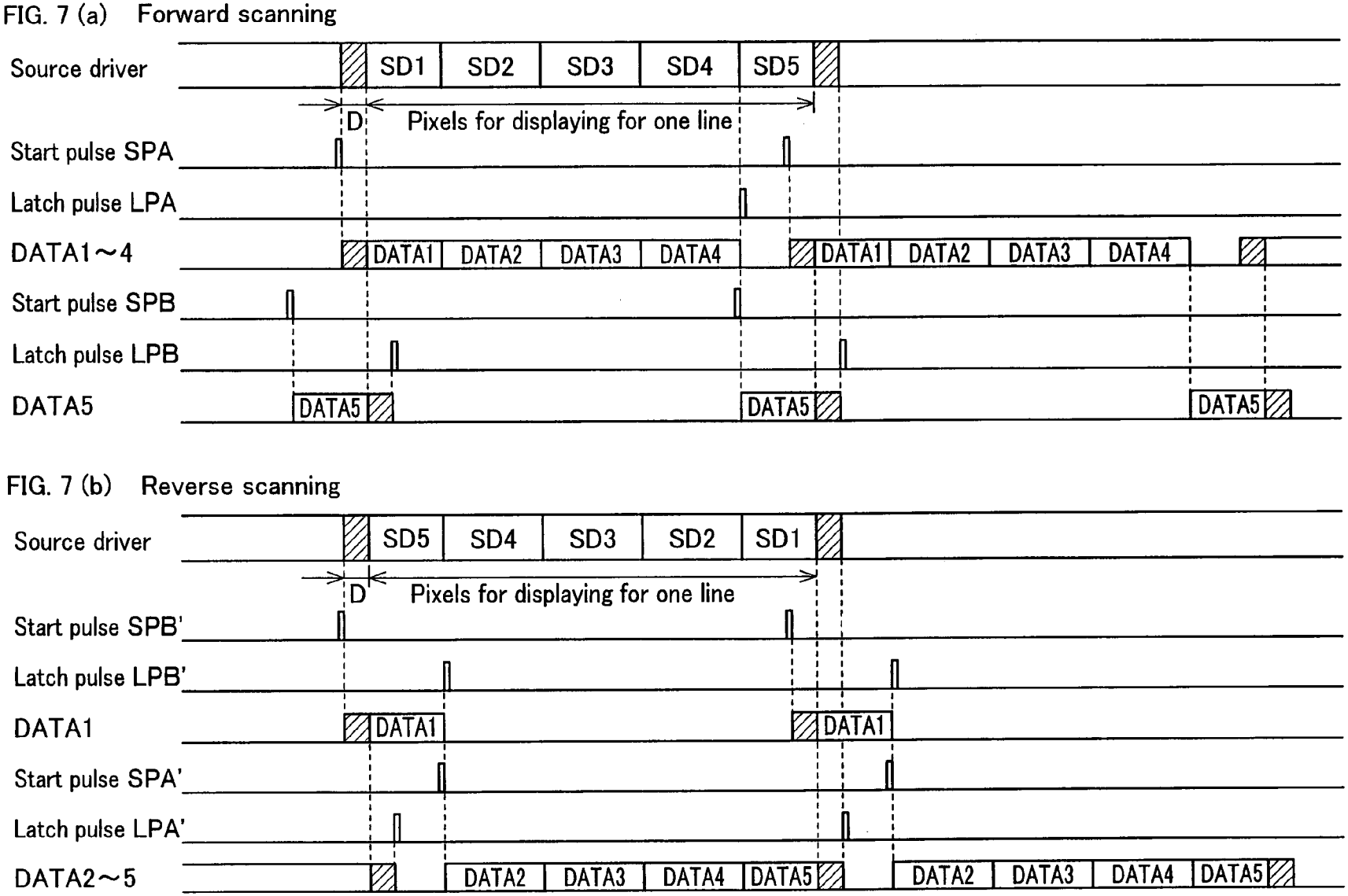
FIG. 7 (a) Forward scanning
Source driver
Start pulse SPA
Latch pulse LPA
DATA1～4
Start pulse SPB
Latch pulse LPB
DATA5
D
Pixels for displaying for one line
SD1
SD2
SD3
SD4
SD5
DATA1
DATA2
DATA3
DATA4
DATA5
FIG. 7 (b) Reverse scanning
Source driver
Start pulse SPB'
Latch pulse LPB'
DATA1
Start pulse SPA'
Latch pulse LPA'
DATA2～5
D
Pixels for displaying for one line
SD5
SD4
SD3
SD2
SD1
DATA1
DATA2
DATA3
DATA4
DATA5

FIG. 15 (a) Prior Art
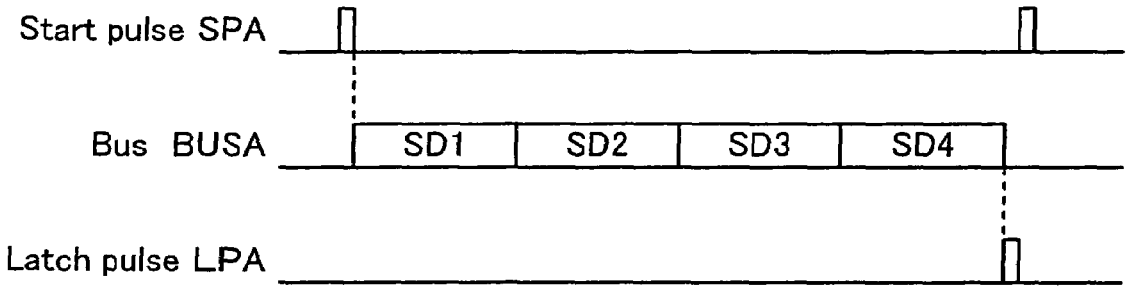
FIG. 15 (b) Prior Art
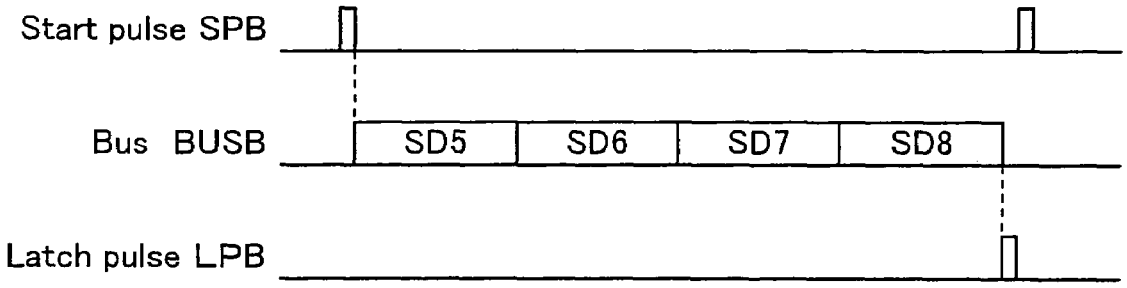

DISPLAY DEVICE AND METHOD OF DRIVING SAME

This Nonprovisional application claims priority under 35 U.S.C. § 119(a) on Patent Application No. 2003-393805 filed in Japan on Nov. 25, 2003 and on Patent Application No. 2004-310073 filed in Japan on Oct. 25, 2004, the entire contents of which are hereby incorporated by reference.

FIELD OF THE INVENTION

The present invention relates to a display device such as a liquid crystal display device typically used for a TV set and also relates to a method of driving the display device. More particularly, the present invention relates to the improvement of an image quality in a case where a data signal line drive circuit has a dummy signal line. The display device and the method of driving thereof can be adopted to an active matrix liquid crystal display device, and preferably to a wide VGA TV set having 854×480 pixels. The display device of the present invention can be used for not only liquid crystal display devices but also electrophoretic displays, twisted ball displays, reflective displays adopting a microscopic prism film, and displays adopting optical modulators, such as digital mirror devices. Furthermore, the display device of the present invention can also be used for (i) displays adopting, as a light-emitting element, elements whose brightness is variable, such as an organic EL element, inorganic EL element, and an LED (Light Emitting Diode), (ii) field emission displays (FEDs), and (iii) plasma displays.

BACKGROUND OF THE INVENTION

As illustrated in FIG. 11, a typical active matrix liquid crystal display device includes: a display area 101; a plurality of scanning signal lines G; a scanning signal line drive circuit (hereinafter, gate driver) 102 that outputs scanning signals to the respective scanning signal lines G; data signal lines SL orthogonal to the respective scanning signal lines G; and a data signal line drive circuit (hereinafter, source driver) 103 that outputs, to the respective data signal lines SL, data signals corresponding to display signals.

This active matrix liquid crystal display device has n scanning signal lines G and m data signal lines D (n and m indicate the numbers of the lines). The gate driver 102 includes gate driver ICs (GDs) for driving n scanning signal lines G, while the source driver 103 includes source driver ICs (SD) for driving m data signal lines D.

As shown in FIG. 12, the scanning lines G are connected to the respective gates of TFTs (Thin Film Transistors) 104 provided in respective pixels on the display area 101. In a similar manner, the data signal lines SL are connected to the respective sources of the TFTs 104. When a scanning signal line G is active, the TFT 104 connected thereto supplies a data signal to a liquid crystal capacity CL. When the scanning signal line is inactive, an electric charge having been applied to the liquid crystal capacity CL connected to the TFT 104 is maintained.

Incidentally, in recent years there have been liquid crystal display devices adopting wide VGA with 854×480 pixels, in order to support the 16:9 aspect ratio of the screen.

In these wide VGA liquid crystal display devices, the number of the data signal lines SL (i.e. m data signal lines) is equal to 854 pixels×red (R), green (G), and blue (B), and hence m=854×3=2562. When these 2562 data signal lines D are driven using source driver ICs (SD) each can drive 384 data signal lines SL, the number of the required source driver ICs (SD) is 7, because 2562/384=6.7.

7 source driver IDs (SD) each can drive 384 data signal lines D are adopted, so that the number of the data signal lines SL is 2688, as 7×384=2688. As a result, 126 data signal lines are redundant, because 2688−2562=126. Note that, since the source drive ICs (SD) are typically standardized products for VGA (640×480 pixels), it is unrealistic to adopt custom-made source driver ICs (SD) with which no data signal line SL is redundant.

As shown in FIG. 13, these 126 data signal lines SL are provided in the following manner: 126 data signal lines SL as dummies (D) are divided into two groups, and these groups each including 126/2=63 data signal lines SL are provided on the left side of the leftmost source driver IC (SD1) and on the right side of the rightmost source river IC (SD7), respectively. These groups on the right and left sides include identical numbers of the data signal lines SL as the dummies, because, in the case of television, the scanning is carried out both from the right side and the left side, so that the scanning from the right side and the scanning from the left side must be performed on an identical condition. Note that, 63 dummy signals on one side are assigned to R, G, and B, and R, G, and B signals are simultaneously output in one clock. The number of clocks for the dummy signals is therefore 63/3 (R, G, and B)=21.

The following describes a case where image reproduction is performed using the aforesaid source driver ICs (SD1 to SD7). It is noted that the image reproduction on the display area 101 is based on the premise that, data for one horizontal period is stored when a start pulse (SP) is given, and subsequently, at the appearance of a latch pulse (LP), the data is supplied to the display area 101 at a stroke, via the data signal lines SL.

As shown in FIG. 13, a start pulse (SP) for one clock is given for a start, and after clocks D for the dummy signals of the source driver IC (SD1) elapse, the source driver IC (SD1) starts to store a set of display data. Then the source driver ICs (SD2 to SD7) store respective sets of display data. After the last source driver IC (SD7) finishes the storage of the set of display data, a latch pulse (LP) is given and these stored sets of display data for one horizontal period are supplied to the display area 101 at a stroke, via the data signal lines SL.

In the image reproduction method above, a blank period for at least α clocks is required from the finish of the storage of the sets of data for one horizontal period to the start of the storage of the sets of data for the next horizontal period. These a clocks are made up of the following clocks:

clocks C1 from the finish of the storage of the display data to the start of the latch pulse (LP);

clocks C2 from the start of the latch pulse (LP) to the start of the start pulse (SP) of the next line;

clocks C3 from the start of the start pulse (SP) to the start of the output of the dummy signals; and clocks C4 for the output of the dummy signals.

In the example above, provided that C2=2 clocks and C3=1 clock, C4=D=21 clocks. Therefore, the following equation is formed:

$$\begin{aligned}\alpha\ \text{clocks} &= C1 + C2 + C3 + C4\\ &= C1 + 2 + 1 + D\\ &= C1 + 2 + 1 + 21\\ &= C1 + 24\end{aligned}$$

Therefore, a clocks is at least 24 clocks even if C1=0. As a result, the increase of the dummy (D) signal lines results in the prolongation of one horizontal period. In other words, the number of clocks in one horizontal period increases.

To avoid this elongation of one horizontal period, for instance, Patent Document 1 teaches that the clock frequency is increased. However, since the number of clocks in one horizontal period does not decrease even if the clock frequency is increased, this method is ineffective and noncontributory.

To solve this problem, for instance, Japanese Laid-Open Patent Application No. 5-35221/1993 (published on Feb. 12, 1993) discloses the following method shown in FIG. 14: A display area 201 is, for instance, divided into a display area 201*a* and a display area 201*b*. In line with this division, source driver ICs (SD1 to SD8) are divided into two groups: the source driver ICs (SD1 to SD4) and the source driver ICs (SD5 to SD8). These two groups of the source driver ICs are driven by two buses BUSA and BUSB through two systems of video signal supply lines 202*a* and 202*b*, respectively.

According to this driving method, as shown in FIG. 15(*a*), the source driver ICs (SD1 to SD4) starts to store respective sets of display data, when a start pulse (SPA) is given. Subsequently, after the data storage by the last source driver IC (SD4) finishes, a latch pulse (LPA) is given, so that the sets of data having been stored in the source driver ICs (SD1 through SD4) are supplied to the display area 201*a* at a stroke, via the respective data signal lines SL of the bus BUSA.

Simultaneously with the above, as shown in FIG. 15(*b*), the source driver ICs (SD5 to SD8) start to store respective sets of display data, when the start pulse (SPA) is given. Subsequently, after the data storage by the last source driver IC (SD8) finishes, the latch pulse (LPA) is given, so that the sets of data having been stored in the source driver ICs (SD5 through SD8) are supplied to the display area 201*b* at a stroke, via the respective data signal lines SL of the bus BUSB.

According to this driving method, image reproduction can be realized by clocks half as much as one horizontal period. For this reason, even if the dummy signal lines are provided on the left side of the source driver IC (SD1) and on the right side of the source driver IC (SD8), the number of clocks does not exceed the number of clocks in one horizontal period.

However, in the liquid crystal display device of Japanese Laid-Open Patent Application No. 5-35221/1993, the source driver ICs are driven using two buses BUSA and BUSB. This requires a circuit dedicated to the drive by these two buses BUSA and BUSB, thereby complicating overall circuitry.

SUMMARY OF THE INVENTION

The objective of the present invention is to provide (i) a display device that can properly reproduce images without adopting complicated circuitry and elongating one horizontal period, when a data signal line drive circuit has dummy signal lines, and (ii) a method of driving the aforesaid display device.

To achieve the above-described objective, the display device of the present invention comprises: scanning signal lines; data signal lines being orthogonal to the respective scanning signal lines; a display section on which pixels corresponding to respective intersections of the scanning signal lines and the data signal lines, the pixels being connected to the scanning signal lines and the data signal lines via switching sections; a scanning signal line drive circuit that drives the scanning signal lines; data signal line drive circuit made up of individually-driven circuits each acquiring a video signal in response to a start pulse, and each driving, in response to a latch pulse, an identical number of data signal lines in order to output the acquired video signal to the data signal lines, the individually-driven circuits being grouped into at least a first individually-driven circuit group and a second individually-driven circuit group each controlling acquisition of the video signal from an identical path; and a drive control section for outputting: a first start pulse and a first latch pulse both for driving the first individually-driven circuit group; and a second start pulse and a second latch pulse both for driving the second individually-driven circuit group.

Also, to achieve the above-described objective, the method of driving the display device of the present invention is arranged in such a manner that, the display device comprises: scanning signal lines; data signal lines being orthogonal to the respective scanning signal lines; a display section on which pixels corresponding to respective intersections of the scanning signal lines and the data signal lines, the pixels being connected to the scanning signal lines and the data signal lines via switching sections; a scanning signal line drive circuit that drives the scanning signal lines; and a data signal line drive circuit that acquires a video signal in response to a start pulse, and outputs the acquired video signal to the data signal lines, in response to a latch pulse, the data signal line drive circuit being made up of individually-driven circuits each driving an identical number of data signal lines, the individually-driven circuits being grouped at least into a first individually-driven circuit group and a second individually-driven circuit group, the first individually-driven group being driven with a first start pulse and a first latch pulse, and the second individually-driven circuit group being driven with a second start pulse and a second latch pulse.

According to the above-described invention, the data signal line drive circuit is made up of individually-driven circuits each driving an identical number of data signal lines, and these individually-driven circuits are grouped into at least a first individually-driven circuit group and a second individually-driven circuit group each controlling the acquisition of a video signal from an identical path.

The drive control section outputs a first start pulse and a first latch pulse so as to drive the first individually-driven circuit group, while outputs a second start pulse and a second latch pulse so as to drive the second individually-driven circuit group.

In the present invention, the data signal line drive circuit has two groups of the individually-driven circuits. This does not, however, complicate the mechanism of acquiring the video signal, because both of the first and second individually-driven circuit groups acquire the video signal from an identical path.

For this reason, it is possible to provide (i) a display device that can properly reproduce images without adopting complicated circuitry and elongating one horizontal period, when a data signal line drive circuit has dummy signal lines, and (ii) a method of driving the aforesaid display device.

For a fuller understanding of the nature and advantages of the invention, reference should be made to the ensuing detailed description taken in conjunction with the accompanying drawings.

BRIEF DESCRIPTION OF THE DRAWINGS

FIG. 7(*a*) is a timing chart showing a method of driving a source driver of a liquid crystal display device of Embodiment 2, when forward scanning is performed, while FIG. 7(*b*) is a timing chart showing the aforesaid method when reverse scanning is performed.

FIGS. 15(*a*) and 15(*b*) are timing charts showing a method of driving a source driver of another conventional liquid crystal display device.

DESCRIPTION OF THE EMBODIMENTS

First Embodiment

The following will describe an embodiment of the present invention in reference to FIGS. 1 through 6.

Figure 1:
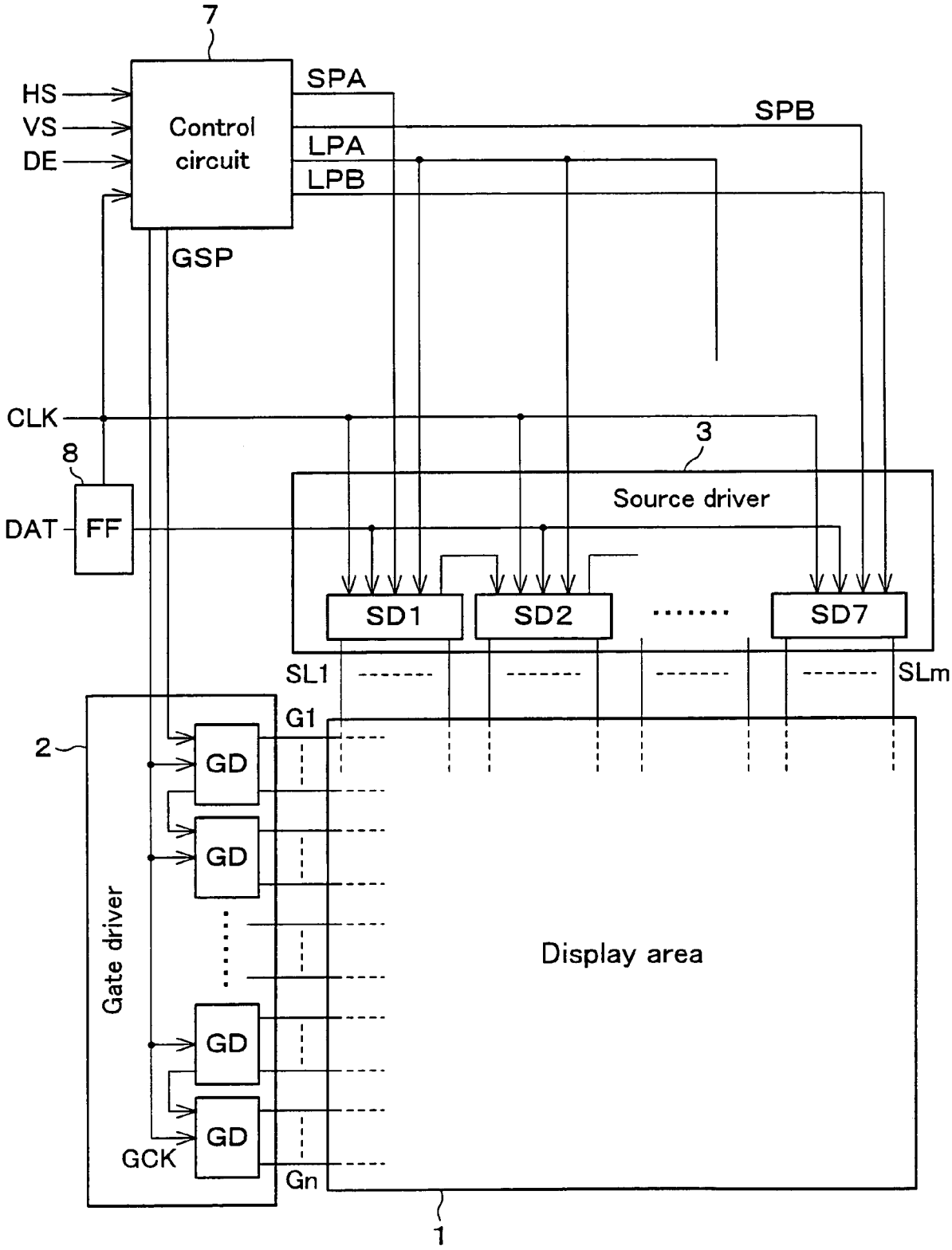
FIG. 1 relates to one embodiment of the present invention, and is a block diagram showing a liquid crystal display device.

As shown in FIG. 1, an active matrix liquid crystal display device, which is a display device of the present embodiment, includes: a display area 1 as a display section; scanning signal lines G; a scanning signal line drive circuit (hereinafter, gate driver) 2 that outputs scanning signals to the scanning signal lines G; data signal lines SL substantially orthogonal to the respective scanning signal lines G; and a data signal line drive circuit (hereinafter, source driver) 3 that outputs, to the data signal lines SL, data signals corresponding to display signals.

This active matrix liquid crystal display device has n scanning signal lines G and m data signal lines SL (n and m indicate the numbers of the lines), and is provided with the gate driver 2 for driving n scanning signal lines G and the source driver 3 for driving m data signal lines SL. The gate driver 2 includes a plurality of gate driver ICs (GD), while the source driver 3 includes a plurality of source driver ICs (SD).

Figure 2:
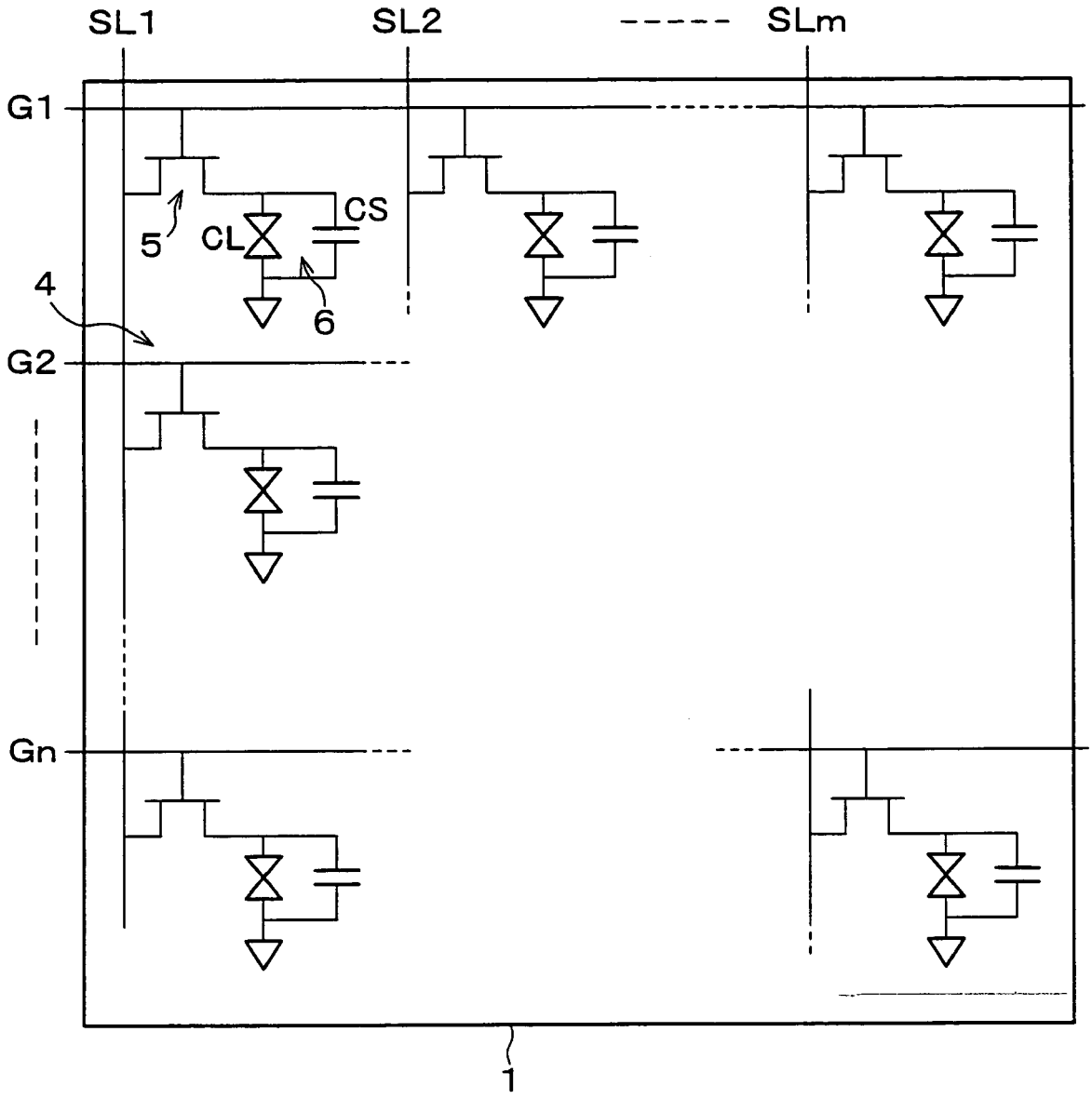
FIG. 2 is a block diagram showing pixels in a display area of the aforesaid liquid crystal display device.

As shown in FIG. 2, the scanning signal lines G are connected to the gates of TFTs (Thin Film Transistors) 5 that are field-effect switching sections corresponding to respective pixels 4 on the display area 1. In a similar manner, the data signal lines SL are connected to the sources of the TFTs 5. The drains of the TFTs 5 are connected to pixel capacities 6 each made up of a liquid crystal capacity CL as a liquid crystal element and an auxiliary capacity CS that is added as occasion demands.

When the scanning signal line G is selected, the TFT 5 of the pixel 4 turns on, and a voltage on the data signal line SL flows into the liquid crystal capacity CL. On the other hand, while the TFT 5 is in OFF state after the aforesaid selection of the scanning signal line G finishes, the liquid crystal capacity CL maintains the voltage at the time of turn-off of the TFT 5. The transmittance or reflectance of the liquid crystal changes in accordance with a voltage applied to the liquid crystal capacity CL. On this account, the display condition of the pixel 4 can be varied in accordance with video data supplied to the pixel 4, by selecting the scanning signal line G and supplying, to the data signal line SL, a voltage corresponding to the video data.

Note that, although the present embodiment takes liquid crystal as an example, the pixel 4 may be another type of pixel (regardless of self-luminous or not), as long as the brightness of the pixel can be adjusted in accordance with a signal applied to the data signal line SL, while a signal indicating the selection has been applied to the scanning signal line G.

Now, how the aforesaid liquid crystal display device is driven is described.

As shown in FIG. 1, in order to control the gate driver 2 and the source driver 3, the liquid crystal display device has a control circuit 7 as drive control means and a latch circuit 8 made up of a plurality of flip-flop circuits FF.

Upon receiving an HS signal, VS signal, DE signal, and clock signal (CLK), the control circuit 7 outputs a start pulse SPA, start pulse SPB, latch pulse LPA, and latch pulse LPB. In other words, as described below, there are two types of start pulses SPA and SPB and two types of latch pulses LPA and LPB in the present embodiment.

Figure 3:
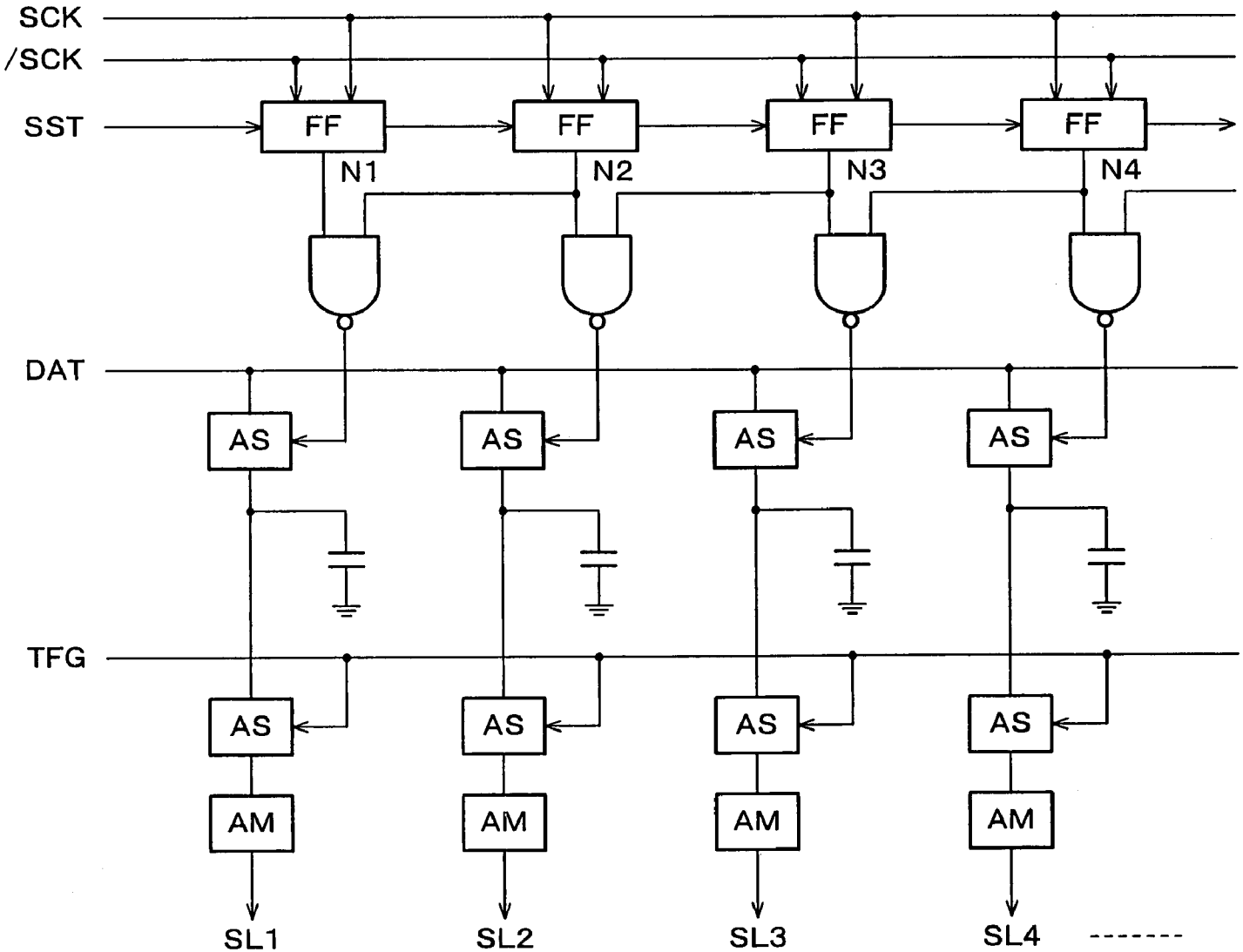
FIG. 3 is a block diagram showing a source driver of the aforesaid liquid crystal display device.

The source driver 3 of the present embodiment is the line-sequential type. This line-sequential source driver 3 is, as FIG. 3 shows, arranged in the following manner: In synchronism with output pulses N of respective latch stages of the shift register made up of the flip-flop circuits FF, a video signal DAT supplied through a single path is fetched by switching analogue switches AS for sampling. Then signals for one horizontal scanning period are simultaneously supplied to the next stage, and written into the data signal lines SL via amplifiers AM. It is noted that the source driver 3 of the present invention is not limited to this arrangement shown in FIG. 3.

Incidentally, wide VGA with 854×480 pixels has been adopted in order to support the 16:9 aspect ratio of the screen.

In the case of this wide VGA, the number of the data signal lines D (i.e. m data signal lines) is equal to 854 pixels×red (R), green (G), and blue (B), and hence m=854×=2562. When these 2562 data signal lines SL are driven using source driver ICs (SD) each can drive 384 data signal lines SL, the number of the required source driver ICs (SD) is 7, because 2562/384=6.7.

7 source driver IDs (SD) each can drive 384 data signal lines SL are adopted, so that the number of the data signal lines SL is 2688, as 7×384=2688. As a result, 126 data signal lines are redundant, as 2688−2562=126. Note that, the present embodiment is based on the premise that typically standardized source drive ICs (SD) for VGA (640×480 pixels) are adopted.

Figure 4:
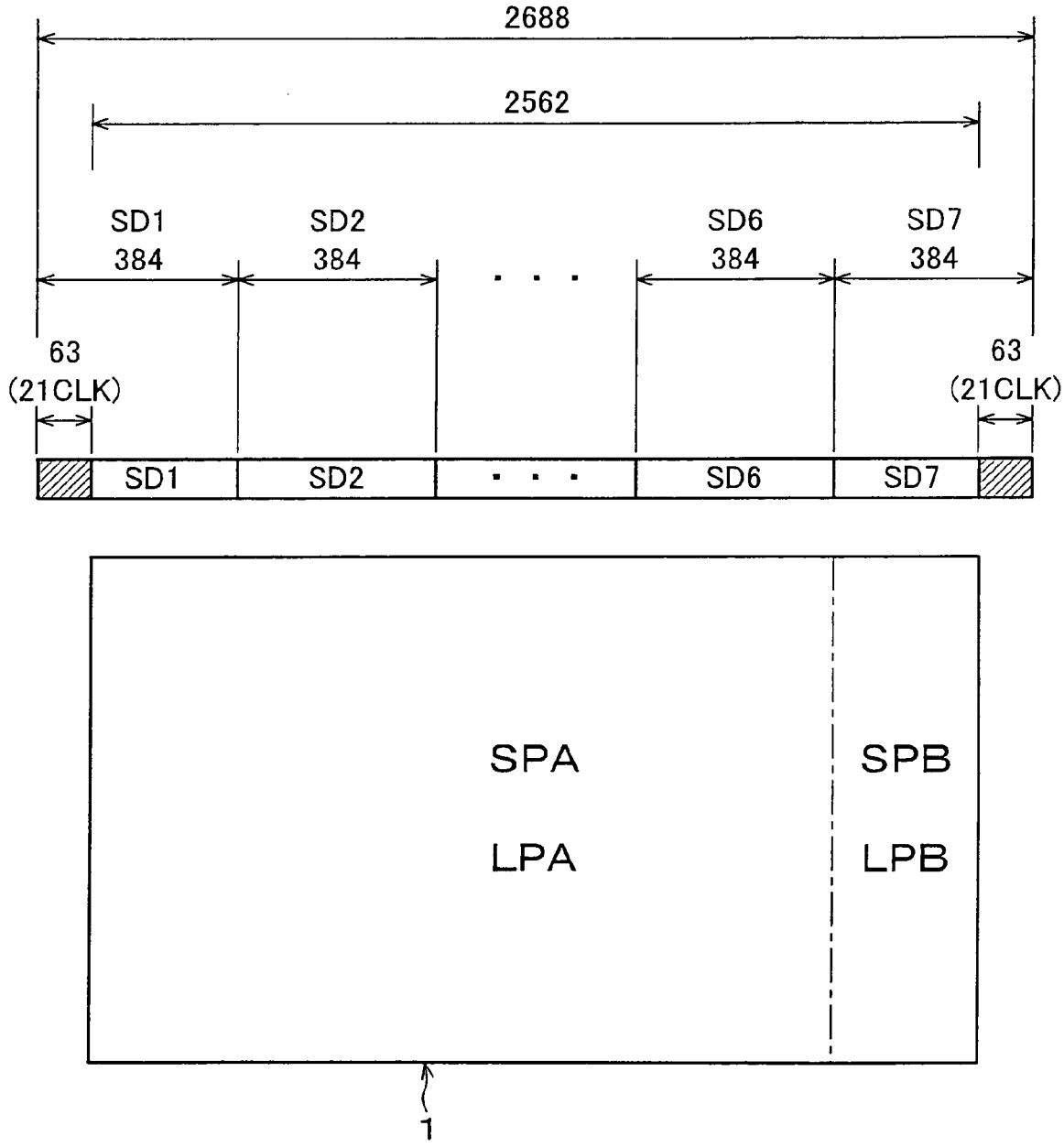
FIG. 4 illustrates how source driver IC (SD) groups of the aforesaid liquid crystal display device are arranged.

As shown in FIG. 4, these 126 data signal lines SL are provided in the following manner: 126 data signal lines SL as dummies (D) are divided into two groups, and these groups each including 126/2=63 data signal lines SL are provided on the left side of the leftmost source driver IC (SD1) and on the right side of the rightmost source river IC (SD7), respectively. Note that, 63 dummy signals on one side are assigned to R, G, and B, and R, G, and B signals are simultaneously output in one clock. The number of clocks for the dummy signals is therefore 63/3 (R, G, and B)=21 (CLK). The groups on the right and left sides include identical numbers of the data signal lines SL as the dummies, because, in the case of television, the scanning is carried out both from the right side and the left side, so that the scanning from the right side and the scanning from the left side must be performed on an identical condition.

In the present embodiment, twp types of start pulses (SP) and two types of latch pulses (LP) are output using a common data bus. That is to say, as FIG. 4 shows, for instance, source driver ICs (SD1 to SD6) are grouped as a first individually-driven circuit group, and are driven by the start pulse SPA as a first start pulse and the latch pulse LPA as a first latch pulse, meanwhile, a soured driver IC (SD7) is designated as a second individually-driven circuit group, and is driven by a start pulse SPB as a second start pulse and a latch pulse LPB as a second latch pulse.

Figure 5:
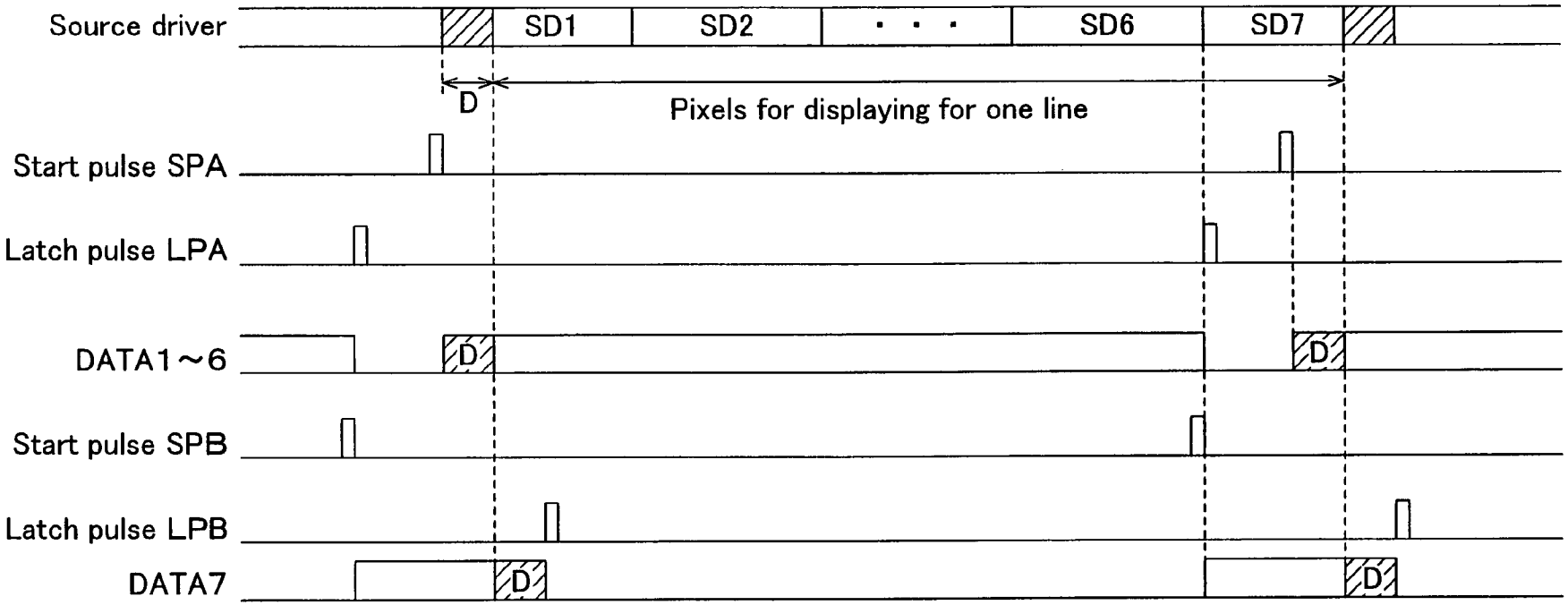
FIG. 5 is a timing chart showing a method of driving the source driver of the aforesaid liquid crystal display device.

According to this method, as shown in FIG. 5, a start pulse SPA is given for a start, and after clocks D for dummy signals of the source driver IC (SD1) elapse, the source driver IC (SD1) starts to store a set of display data. Subsequently, the source driver ICs (SD2 to SD6) sequentially store respective sets of display data. On the occasion that the last source driver IC (SD6) finishes the storage of the set of display data, a latch pulse (LPA) is given and these sets of display data for one horizontal period, having been stored in the respective source driver ICs (SD1 to SD6), are supplied to the display area 1 at a stroke, via the data signal lines SL.

In the meanwhile, before the output of the latch pulse LPA, another start pulse SPB is given. With this, the source driver IC (SD7) stores a set of display data. Subsequently, on the occasion of the finish of the data storage by the source driver IC (SD7), a latch pulse LPB is given so that the set of data having been stored in the source driver IC (SD7) is supplied to the display area 1, via the data signal lines SL.

That is to say, in the driving method of the present embodiment, video signals DAT are supplied to the source driver ICs SD1 to SD7 in due order (i.e. the source driver IC SD1 receives the signal first, and the source driver IC SD7 receives the signal last). For this reason, the image reproduction by the source driver IC SD7 cannot be performed concurrently with the image reproduction by the source driver ICs SD1 to SD6. The timing of the next start pulse SPA is determined so as to meet the following condition: after the clocks D for the dummy signals of the source driver IC (SD1) elapse (i.e. after sampling the dummy signals), a piece of data that is initially sampled for the valid data signal line SL of the source driver IC (SD1) is supplied to the first pixel (the leftmost pixels on the respective scanning signal lines) of the display area 1.

The timing of the start pulse SPB is determined so as to meet the following condition: a piece of data that is initially sampled and supplied to the data signal line of the source driver IC (SD7) is supplied to the pixel that performs image reproduction for the first time among the pixels corresponding to the source driver IC (SD7). The timing of the latch pulse LPA must fall within a timing range where the sets of data stored in the source driver ICs (SD1 to SD6) can be supplied to the display area 1 at a stroke, via the data signal lines SL. The timing of the latch pulse LPB must fall within a timing range where the set of data stored in the source driver IC (SD7) can be supplied to the display area 1 at a stroke, via the data signal lines SL.

With the driving method above, a liquid crystal display device can be driven regardless of the number of clocks D for the dummy signals and even if the clock for a horizontal blanking period is 0.

Figure 6:
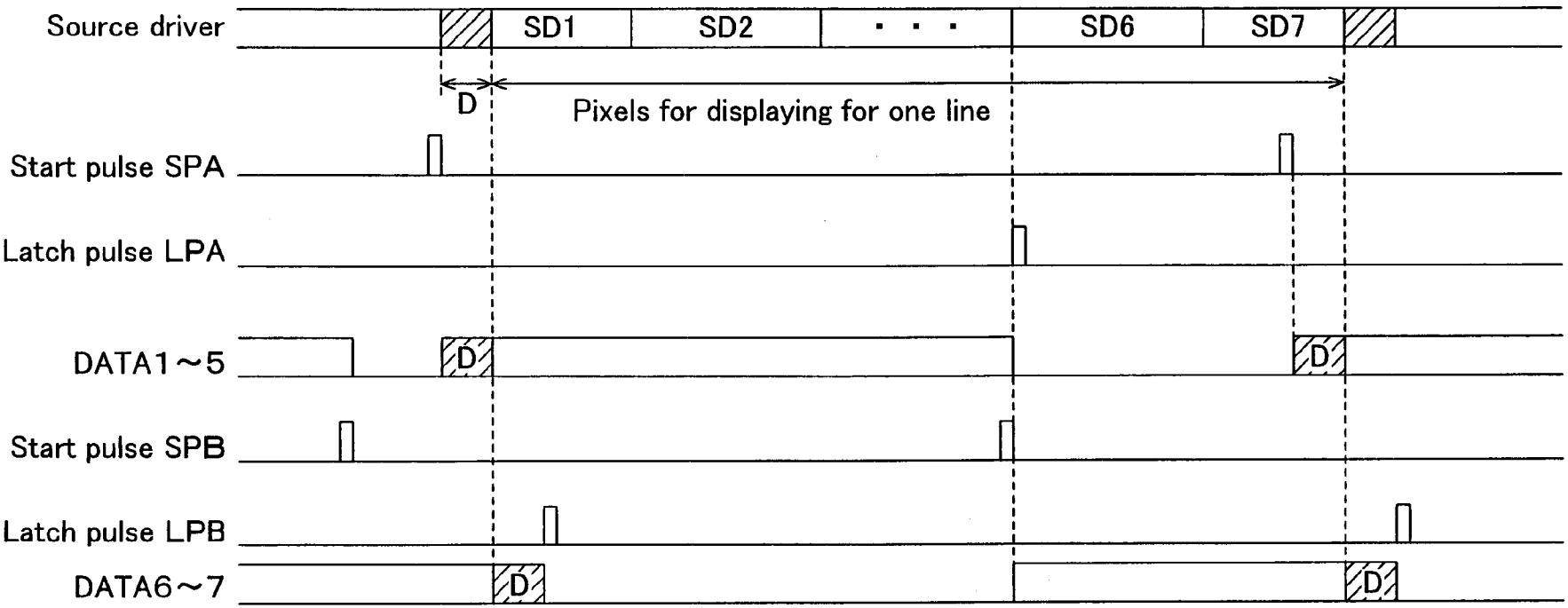
FIG. 6 is a timing chart showing another method of driving the source driver of the aforesaid liquid crystal display device.

In the method above, the source driver ICs (SD) of the source driver 3 are divided into the source driver ICs (SD1 to SD6) and the source driver IC (SD7). The method, however, is not limited to this. For instance, as shown in FIG. 6, the source driver ICs may be divided into the source driver ICs (SD1 to SD5) and the source driver ICs (SD6 and SD7). This arrangement also allows a liquid crystal display device to be driven regardless of the number of clocks D for the dummy signals and even if the clock for a horizontal blanking period is 0.

As described above, according to the liquid crystal display device of the present embodiment and the method of driving the same, the source driver 3 is made up of source driver ICs (SD) each driving the identical number of data signal lines SL (i.e. 384 data signal lines), and these source driver ICs (SD) are divided into at least two groups: for instance, one group including the source driver ICs (SD1 to SD6) and the other group including the source driver IC (SD7).

The control circuit 7 drives the source driver ICs (SD1 to SD6) by supplying the start pulse SPA and the latch pulse LPA, and also drives the source driver IC (SD7) by supplying the start pulse SPB and the latch pulse LPB.

Thanks to the arrangement above, a liquid crystal display device can be driven regardless of the number of clocks D for the dummy signals and even if the clock for a horizontal blanking period is 0, and also even in a case where the total number (e.g. 2688) of terminals of the source driver ICs (SD), the terminals being connected to the data signal lines, is larger than the number (e.g. 2562) of the data signal lines SL actually required for the image reproduction on all of the pixels.

In the present embodiment, the source driver 3 has two groups of source driver ICs (SD). Even so, this does not complicate the mechanism of obtaining the video signal DAT, because, for instance, both the source driver ICs (SD1 to SD6) and the source driver IC (SD7) obtain the same video signal DAT from one path.

It is therefore possible to realize the liquid crystal display device and the method of driving the same, by which image reproduction can be performed without adopting complicated circuitry and performing the elongation of one horizontal period, when the source driver 3 has terminals for dummy signal lines.

In the liquid crystal display device of the present embodiment, for instance, before the sampling of dummy data, the control circuit 7 outputs the start pulse SPA for driving the source driver ICs (SD1 to SD6), in such a manner as to cause a piece of the data, which is initially sampled for the input to the valid data signal line SL of the source drivers ICs (SD1 to SD6), to correspond to the initial pixel of the display area 1.

With this driving method, a display device can be driven regardless of the clocks D of the dummy signals and even if the clock for the horizontal blanking period is 0.

In the liquid crystal display device of the present embodiment and the method of driving the same, furthermore, the terminals for outputting dummy data are provided on the left side of the leftmost source driver IC (SD1) and on the right side of the rightmost source driver IC (SD7).

The present invention can therefore be used for a case where the scanning is performed both from the right side and from the left side on equal conditions, which is typically performed in the case of a TV set. For this reason, the terminals for outputting dummy data are preferably provided equally on the left side of the leftmost source driver IC (SD1)

of the display area 1 and on the right side of the rightmost source driver IC (SD7) of the display area 1.

On the occasion that liquid crystal elements are adopted as the display elements, the present embodiment can realize a liquid crystal display device which can properly reproduce images without adopting complicated circuitry and extending one horizontal period, when the source driver 3 has dummy signal lines.

Embodiment 2

Figure 8:
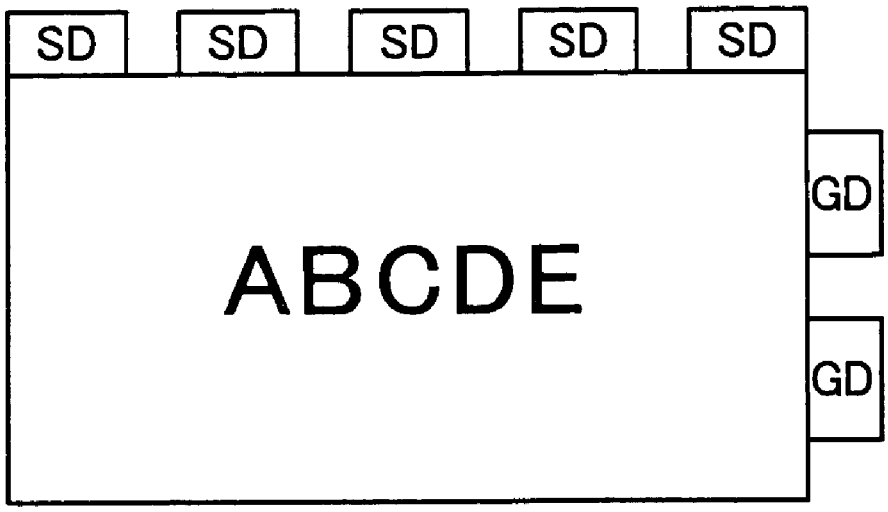
FIG. 8(*a*) is a block diagram showing a liquid crystal display device in which a source driver is provided on the top side, while FIG. 8(*b*) is a block diagram showing a liquid crystal display device in which a source driver is provided on the bottom side.
Figure 8:
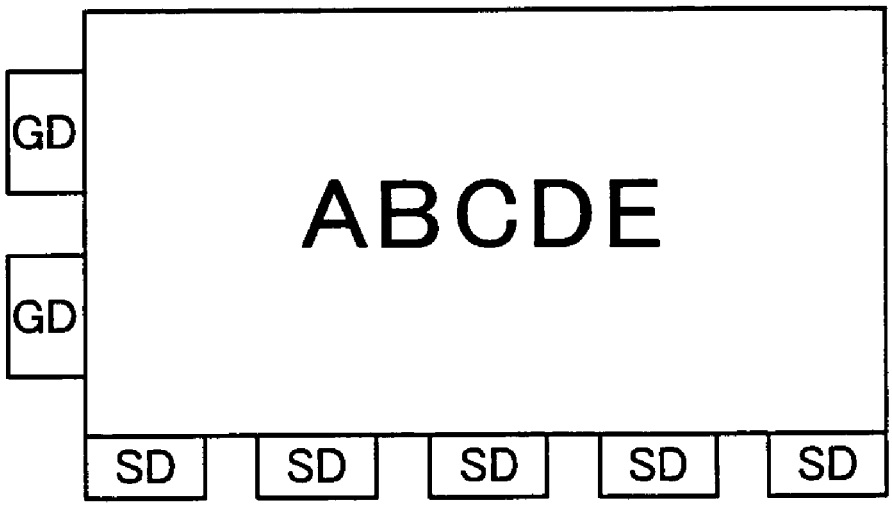

The following will describe another embodiment of the present invention with reference to FIGS. 7 and 8. The present embodiment relates to differences from Embodiment 1. Thus members having the same functions as those described in Embodiment 1 are given the same numbers, so that the descriptions are omitted for the sake of convenience.

As shown in FIG. 7(*a*), the method of driving the liquid crystal display device of Embodiment 1 is arranged in such a manner that the source driver ICs are scanned in the order of SD1, SD2, SD3, and so on (hereinafter, this type of scanning is termed "forward scanning"). The scanning of the source driver ICs is, however, not necessarily carried out in this way. As FIG. 7(*b*) shows, the source driver ICs may be scanned in the order of SD3, SD2, and SD1 (hereinafter, this type of scanning is termed "reverse scanning").

In the reverse scanning, the order of scanning of liquid crystal is reversed so that a displayed image is reversed in the horizontal direction and/or in the vertical direction. Adopting this reverse scanning concurrently with the forward scanning, an image is properly reproduced no matter which side (top side or bottom side) source driver ICs are attached to a liquid crystal module, when, for instance, a TV set is assembled.

That is to say, for instance, by the forward scanning, characters "ABCDE" are properly displayed on a TV set in which the source driver ICs are provided on the top side, as shown in FIG. 8(*a*). On the other hand, as shown in FIG. 8(*b*), it is necessary to carry out the reverse scanning to properly display the characters "ABCDE" on a TV set in which the source driver ICs are provided on the bottom side.

In addition to the above, it is possible to purposefully provide, to a TV set, the functionality of reversing a displayed image from side to side. In other words, there is such an exceptional case that the reverse scanning is performed in a TV set in which source driver ICs are provided on the top side. For instance, in a barber, a television picture is reversed from side to side in order to allow a customer to watch the television picture in the mirror.

To support such an exceptional use, in the method of driving the liquid crystal display device of the present embodiment, the forward scanning and the reverse scanning are switchable no matter which side (top side or bottom side) source driver ICs are attached to.

Each of the source driver ICs and the gate driver ICs typically has two start pulse terminals. Provided that these two start pulse terminals in one source driver IC are referred to as SPI and SPO, on the occasion of the forward scanning, a start pulse supplied to the start pulse terminal SPI sequentially shifts in the source driver ICs and is output from the start pulse terminal SPO, so that the characters "ABCDE" are properly displayed, as shown in FIG. 9(*a*).

Figure 9:
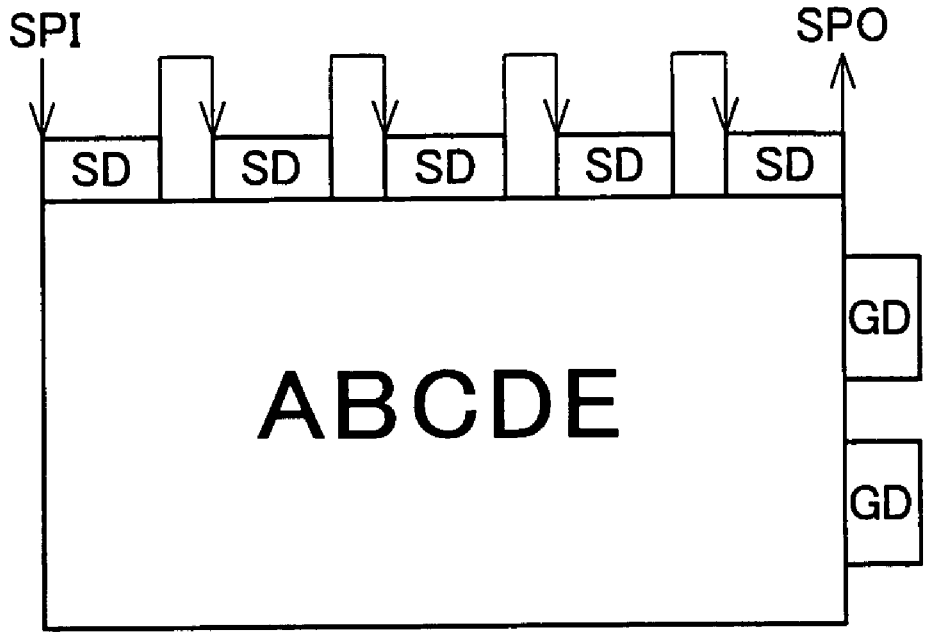
FIG. 9(*a*) is a block diagram of a liquid crystal display device in a case where a start pulse supplied from SPI is sequentially shifted and output from SPO, while FIG. 9(*b*) is a block diagram of a liquid crystal display device in a case where a start pulse supplied from SPO is sequentially shifted and output from SPI.
Figure 9:
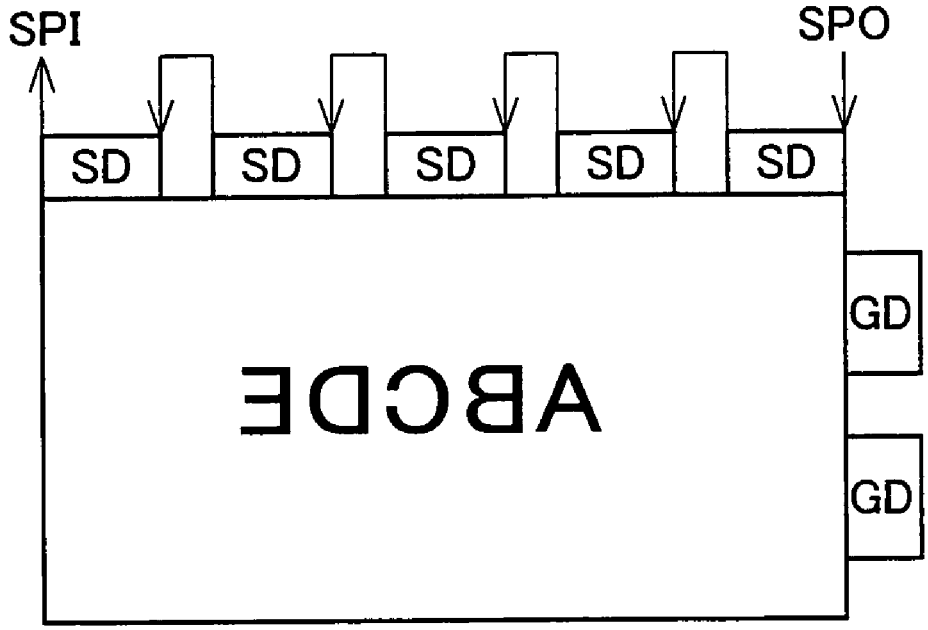

On the other hand, on the occasion of the reverse scanning, as shown in FIG. 9(*b*), a start pulse supplied to the start pulse terminal SPO sequentially shifts in the source driver ICs, and is output from the start pulse terminal SPI. As a result, the characters "ABCDE" are displayed in a mirror-reversed manner. To which terminal (SPI or SPO) the start pulse is supplied is determined by supplying either a signal L or a signal H to a scanning direction setting terminal of the source driver IC. By switching these input signals, the forward scanning and the reverse scanning can be switched.

Referring to FIG. 7(*b*) the aforesaid reverse scanning will be discussed in detail. By the way, for convenience' sake, the number of source driver ICs in this case is 5 (from SD1 to SD5).

According to the driving method of the present embodiment, as shown in FIG. 7(*b*), for instance, source driver ICs (SD1 to SD4) are grouped as a first individually-driven circuit group, and are driven by a start pulse SPA as a first start pulse and a latch pulse LPA as a first latch pulse, while a source driver IC (SD5) is set as a second individually-driven circuit group, and is driven by a start pulse SPB as a second start pulse and a latch pulse LPB as a second latch pulse.

As shown in the figure, the start pulse SPB is given, and after clocks D corresponding to the dummy signals of the source driver IC (SD5) elapse, the source driver IC (SD5) starts to store a set of display data (DATA1). Subsequently, when the data storage by the source driver IC (SD5) finishes, the latch pulse LPB is given so that the set of data stored by the source driver IC (SD5) is supplied to the display area 1 (see FIG. 1) via the data signal lines SL.

On the other hand, before supplying the set of data to the display area 1 in response to the latch pulse LPB, the start pulse SPA is given. With this start pulse SPA, the source driver ICs (SD4 to SD1) sequentially store respective sets of display data (DATA2 to DATA5). When the storage of the last set of data (DATA5) of the source driver IC (SD1) finishes, the latch pulse LPA is given and the sets of data stored in the source driver ICs (SD1 to SD4) are supplied at a stroke to the display area 1 via the data signal lines SL.

As discussed above, being similar to the case of the forward scanning, the reverse scanning of the present embodiment allows the display device to successfully operate regardless of the number of clocks of the dummy signals and even if the clock for the horizontal blanking period is 0.

Next, to what extent the timings of the start pulse and the latch pulse are identical/different between the forward scanning and the reverse scanning is discussed in detail.

As illustrated in FIGS. 7(*a*) and 7(*b*), the timing of the start pulse SPB' of the reverse scanning is identical with the timing of the start pulse SPA of the forward scanning. On the other hand, the timing of the start pulse SPA' of the reverse scanning is set so as to allow the DATA2 to be output from the source driver IC (SD4).

While the timing of the latch pulse LPA' of the reverse scanning is identical with the timing of the latch pulse LPB of the forward scanning, the timing of the latch pulse LPB' of the reverse scanning is identical with neither the latch pulse LPA nor the latch pulse LPB of the forward scanning.

In the present embodiment, the source driver ICs (SD1 to SD4) are set as the first individually-driven circuit group, while the source driver IC (SD5) is set as the second individually-driven circuit. The timings of the start pulses and latch pulses are therefore set as above. However, the timings are not necessarily set as above, and it is required that the start pulses and the latch pulses are generated at timings suitable for the spec of the source driver ICs.

On this account, the timings of the latch pulses LPA' and LPB' of the reverse scanning may be identical with neither the latch pulse LPA nor the latch pulse LPB of the forward scanning. Also, the timing of the latch pulse LPA' of the reverse scanning may be identical with the timing of the latch pulse LPB of the forward scanning. Moreover, the timing of the latch pulse LPB' of the reverse scanning may be identical with the timing of the latch pulse LPA of the forward scanning.

The timings of the start pulses SPA' and SPB' of the reverse scanning may be identical with neither the start pulse SPA nor the start pulse SPB of the forward scanning. The timing of the start pulse SPA' of the reverse scanning may be identical with the timing of the start pulse SPB of the forward scanning. The timing of the start pulse SPB' of the reverse scanning may be identical with the timing of the start pulse SPA of the forward scanning.

Figure 10:
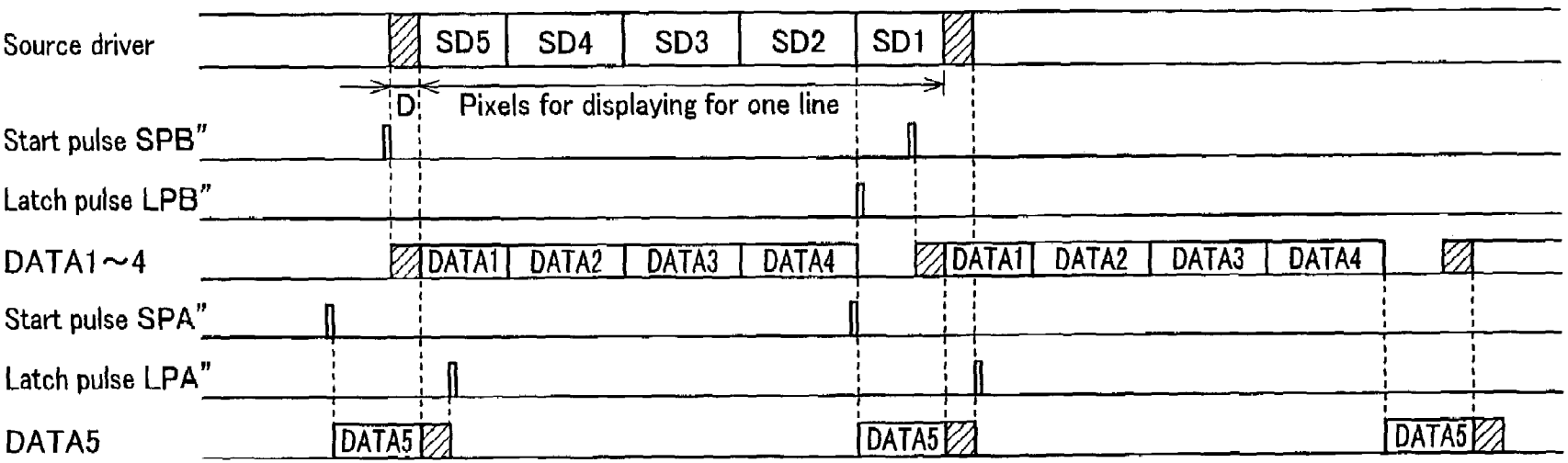
FIG. 10 is a timing chart illustrating a case where another type of reverse scanning is performed in the aforesaid method of driving the source driver.
Figure 11:
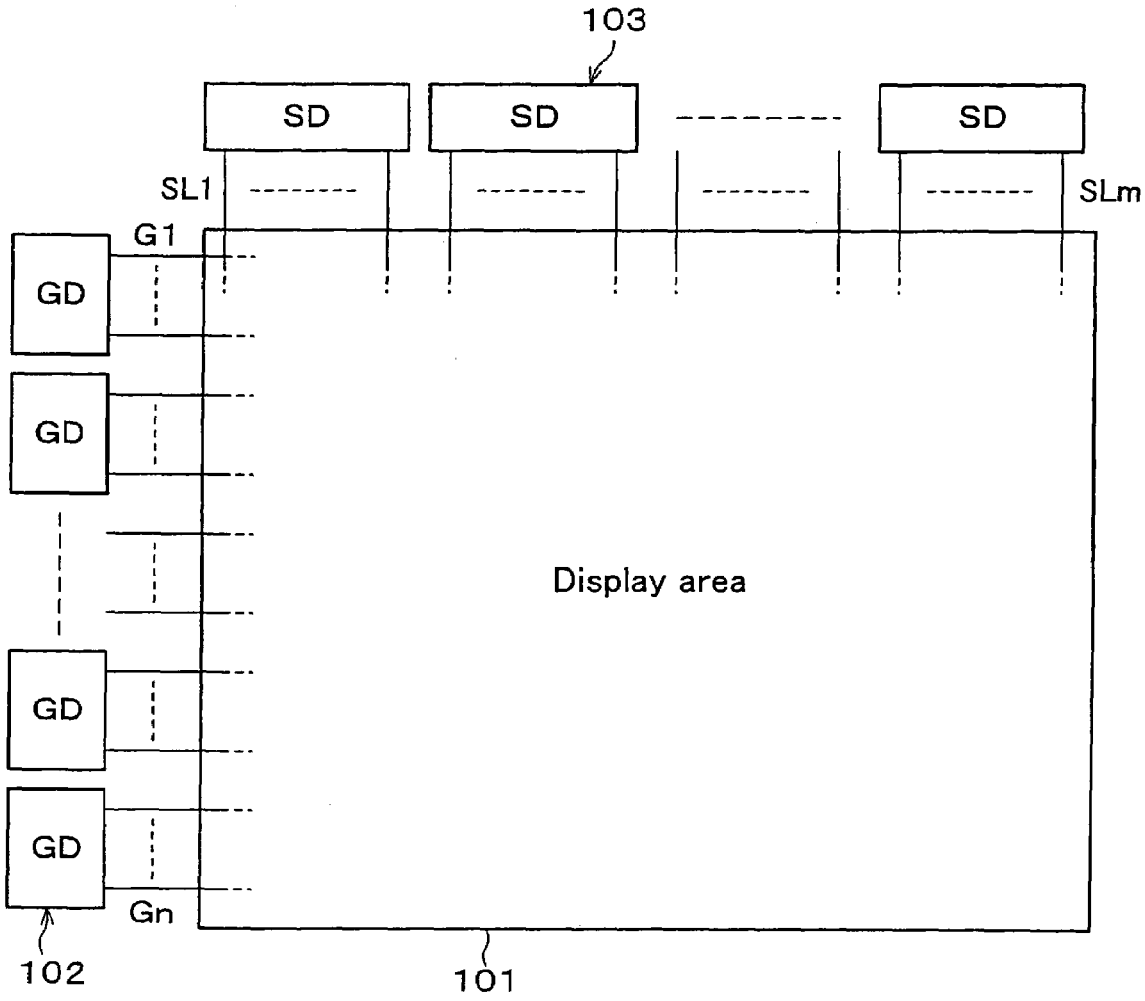
FIG. 11 Prior Art
FIG. 11 is a block diagram showing a conventional liquid crystal display device.
Figure 12:
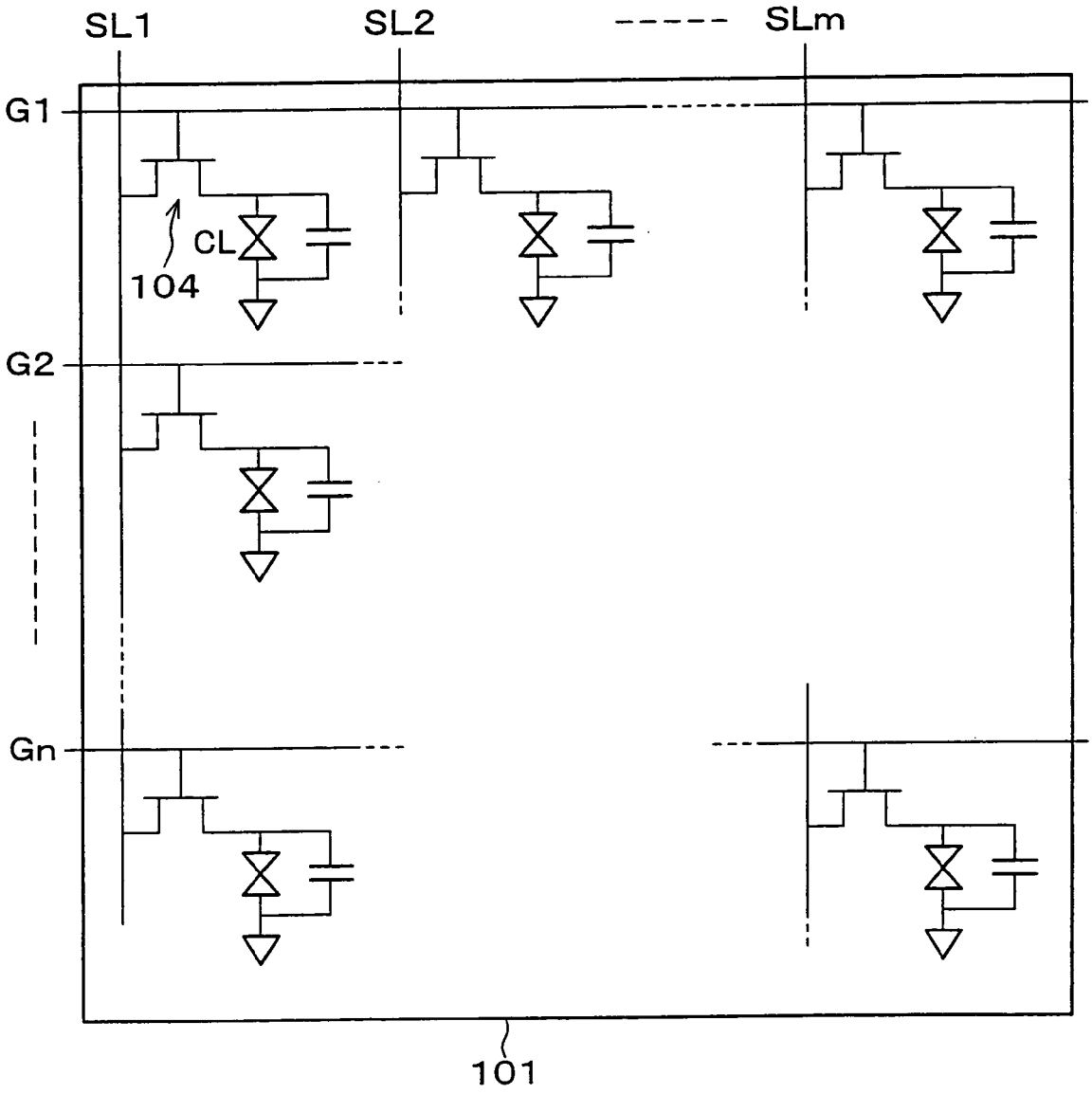
FIG. 12 Prior Art
FIG. 12 is a block diagram showing pixels in a display area of the conventional liquid crystal display device.
Figure 13:
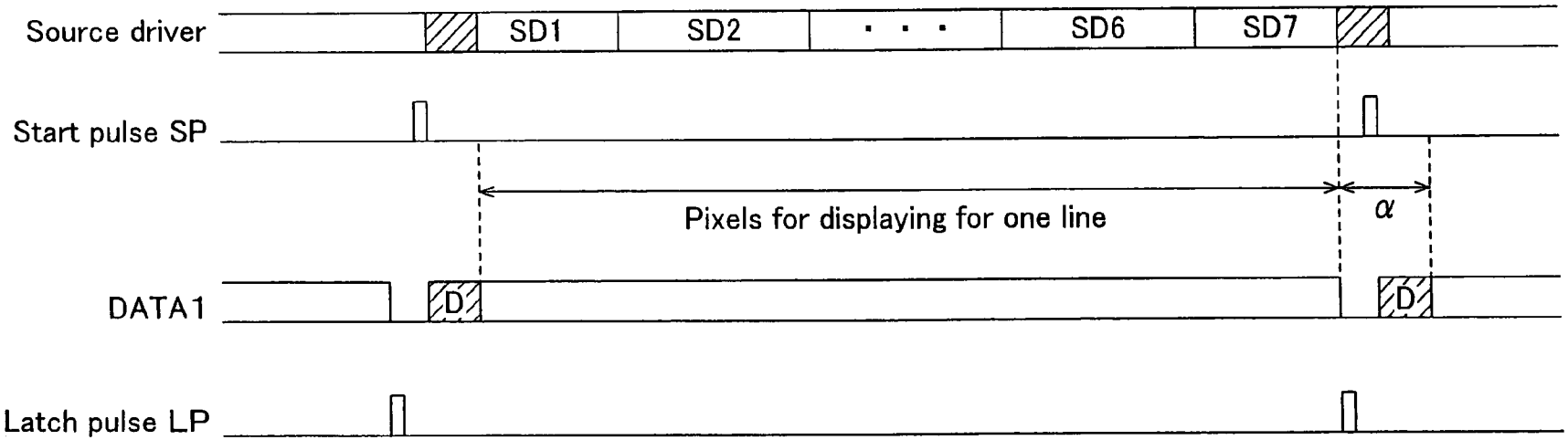
FIG. 13 Prior Art
FIG. 13 is a timing chart illustrating a method of driving a source driver of the conventional liquid crystal display device.
Figure 14:
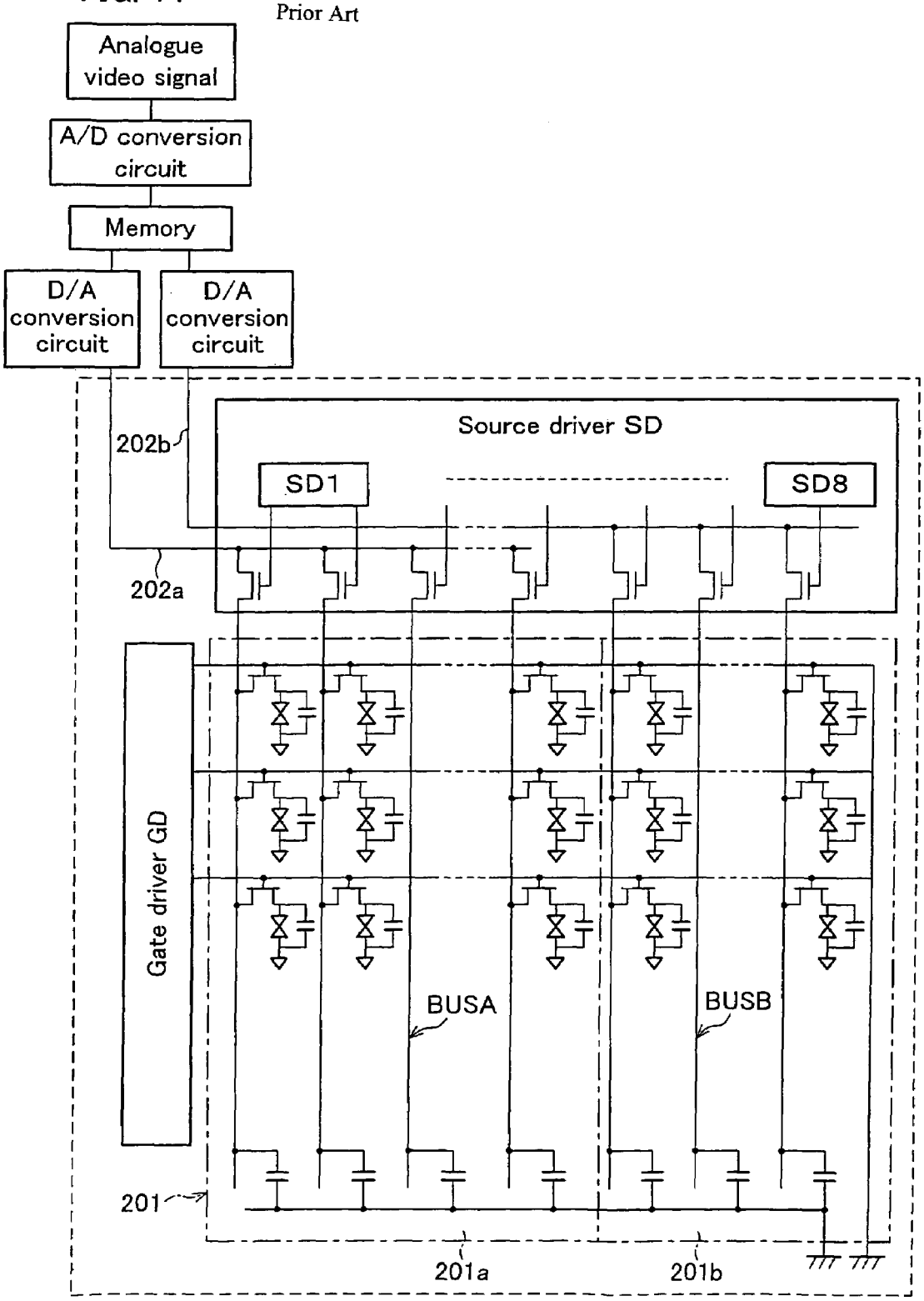
FIG. 14 Prior Art
FIG. 14 is a block diagram showing a method of driving a source driver of a conventional liquid crystal display device.

More specifically, as shown in FIG. 10. the reverse scanning may be arranged in such a manner that, the timings of the start pulses SPA and SPB shown in FIG. 7(*a*) are swapped, and also the timings of the latch pulses LPA and LPB shown in FIG. 7(*a*) are swapped.

In this case, the timing of the start pulse SPB" is identical with the timing of the start pulse SPA of the forward scanning, and the timing of the start pulse SPA" is identical with the timing of the start pulse SPB of the forward scanning. In the meanwhile, the timing of the latch pulse LPB" is identical with the timing of the latch pulse LPA of the forward scanning, and the timing of the latch pulse LPA" is identical with the timing of the latch pulse LPB of the forward scanning.

As shown in FIG. 10, the operation can be successfully performed even if the timings of the start pulses SPA and SPB of the forward scanning are simply swapped and the timings of the latch pulses LPA and LPB of the forward scanning are also simply swapped. As in the case of FIGS. 7(*a*) and 7(*b*), the display device in this case can successfully operate regardless of the number of clocks for the dummy signals and even if the clock for the horizontal blanking period is 0.

As described above, the display device of the present invention is preferably arranged in such a manner that, the individually-driven circuits of the data signal line drive circuit have terminals for the data signal lines, and a total number of the terminals is larger than a number of the data signal lines required for image reproduction on all of the pixels.

Also, the method of driving the display device of the present invention is preferably arranged in such a manner that, the individually-driven circuits of the data signal line drive circuit have terminals for the data signal lines, and a total number of the terminals is larger than a number of the data signal lines required for image reproduction on all of the pixels.

Also, the display device of the present invention is preferably arranged in such a manner that, the driver control means: (i) outputs the first start pulse, so as to cause the first individually-driven circuit group to sequentially output dummy data and data that has been sampled for input to effective ones of the data signal lines; and (ii) outputs the first start pulse, so as to control a timing of a beginning of output of the dummy data, in such a manner as to cause a piece of data initially sampled for input to the effective ones to correspond to initial ones of the pixels.

Also, the method of driving the display device of the present invention is preferably arranged in such a manner that, (i) the first start pulse is output, so that the first individually-driven circuit group is caused to sequentially output dummy data and data that has been sampled for input to effective ones of the data signal lines; and (ii) the first start pulse is output, so that a timing of a beginning of output of the dummy data is controlled, in such a manner as to cause a piece of data initially sampled for input to the effective ones to correspond to initial ones of the pixels.

According to the invention above, the drive control means (i) outputs the first start pulse, so as to cause the first individually-driven circuit group to sequentially output dummy data and data that has been sampled for input to effective ones of the data signal lines; and (ii) outputs the first start pulse, so as to control a timing of a beginning of output of the dummy data, in such a manner as to cause a piece of data initially sampled for input to the effective ones to correspond to initial ones of the pixels.

On this account, the aforesaid driving method allows the display device to certainly operate regardless of the number of clocks for the dummy signals and even if the clock for a horizontal blanking period is 0.

Also, the display device of the present invention is preferably arranged in such a manner that, the terminals for outputting the dummy data are provided on a left side of a leftmost individually-driven circuit of the display section and on a right side of a rightmost individually-driven circuit of the display section.

Also, the method of driving the display device of the present invention is preferably arranged in such a manner that, the terminals for outputting the dummy data are provided on a left side of a leftmost individually-driven circuit of the display section and on a right side of a rightmost individually-driven circuit of the display section.

In the display device of the present invention and the method of driving the same, the terminals for the dummy signals are provided on the left side of the leftmost individually-driven circuit of the display section and on the right side of the rightmost individually-driven circuit of the display section.

With the arrangements above, the present invention can be used for a case where the scanning is performed both from the right side and from the left side on equal conditions, which is typically performed in the case of a TV set.

Also, the display device of the present invention is preferably arranged in such a manner that display elements are made up of liquid crystal elements.

Also, the method of driving the display device of the present invention is preferably arranged in such a manner that display elements are liquid crystal elements.

With the invention above, it is possible to provide the display device that can reproduce images without adopting complicated circuitry and elongating one horizontal period, when the data signal line drive circuit has the terminals for the dummy signal lines.

Also, the method of driving the display device of the present invention may be arranged in such a manner that, when the individually-driven circuits of the data signal line drive circuit acquire data, the video signal is acquired in a direction either from the left side of the leftmost individually-driven circuit to the right side of the rightmost individually-driven circuit or from the right side of the rightmost individually-driven circuit to the left side of the leftmost individually-driven circuit.

According to the invention above, the video signal can be acquired in a direction either from the left side of the leftmost individually-driven circuit to the right side of the rightmost individually-driven circuit or from the right side of the rightmost individually-driven circuit to the left side of the leftmost individually-driven circuit.

For this reason, the aforesaid method can be adopted both to a display device scanned from right to left and a display device scanned from left to right.

Also, the method of driving the display device of the present invention may be arranged in such a manner that, when the individually-driven circuits of the data signal line drive circuit acquire data, a direction of acquiring the video signal can be switched between: a direction from the left side of the leftmost individually-driven circuit to the right side of the rightmost individually-driven circuit; and a direction from the right side of the rightmost individually-driven circuit to the left side of the leftmost individually-driven circuit.

According to the invention above, it is possible to switch between a case where the video signal is acquired in the direction from the left side of the leftmost individually-driven circuit to the right side of the rightmost individually-driven circuit and a case where the video signal is acquired in the direction from the right side of the rightmost individually-driven circuit to the left side of the leftmost individually-driven circuit.

With the above, the present invention can be adopted to a display device such as a TV set, which in some cases preferably has such a function that the scanning from the right side and the scanning from the left side can be switched.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A display device, comprising: scanning signal lines; data signal lines being orthogonal to the respective scanning signal lines; a display section on which pixels corresponding to respective intersections of the scanning signal lines and the data signal lines, the pixels being connected to the scanning signal lines and the data signal lines via switching sections; a scanning signal line drive circuit that drives the scanning signal lines; data signal line drive circuit including a plurality of individually-driven circuits, each of the plurality of individually-driven circuits acquiring a video signal in response to a start pulse and driving an identical number of data signal lines in response to a latch pulse in order to output the acquired video signal to the data signal lines, the plurality of individually-driven circuits being grouped into a first individually-driven circuit group and a second individually-driven circuit group, each of the first individually-driven circuit group and second individually-driven circuit group controlling acquisition of the video signal from a common data bus; and driver control means for outputting: a first start pulse and a first latch pulse both for driving the first individually-driven circuit group; and a second start pulse and a second latch pulse both for driving the second individually-driven circuit group, the first individually-driven circuit group being different from the second individually-driven circuit group, the first start pulse being different from the second start pulse, and the first latch pulse being different from the second latch pulse.

2. The display device as defined in claim 1, wherein the data signal line drive circuit including the plurality of individually-driven circuits includes terminals for the data signal lines, wherein the total number of the terminals is larger than the number of the data signal lines required for image reproduction on all of the pixels.

3. The display device as defined in claim 1, wherein the driver control means:

(i) outputs the first start pulse, so as to cause the first individually-driven circuit group to sequentially output dummy data and display data to the corresponding data signal lines and (ii) outputs the first start pulse, so as to control a timing of a beginning of output of the dummy data, in such a manner as to cause a portion of display data to correspond to initial ones of the pixels.

4. The display device as defined in claim 2, wherein the driver control means:

(i) outputs the first start pulse, so as to cause the first individually-driven circuit group to sequentially output dummy data and display data to the corresponding data signal lines and (ii) outputs the first start pulse, so as to control a timing of a beginning of output of the dummy data, in such a manner as to cause a portion of the display data to correspond to initial ones of the pixels.

5. The display device as defined in claim 3, wherein the terminals for outputting the dummy data are provided on a left side of a leftmost individually-driven circuit of the display section and on a right side of a rightmost individually-driven circuit of the display section.

6. The display device as defined in claim 4, wherein the terminals for outputting the dummy data are provided on a left side of a leftmost individually-driven circuit of the display section and on a right side of a rightmost individually-driven circuit of the display section.

7. The display device as defined in claim 1, wherein the display section includes liquid crystal elements.

8. The display device as defined in claim 2, wherein the display section includes liquid crystal elements.

9. The display device as defined in claim 3, wherein the display section includes liquid crystal elements.

10. The display device as defined in claim 4, wherein the display section includes liquid crystal elements.

11. The display device as defined in claim 5, wherein the display section includes liquid crystal elements.

12. The display device as defined in claim 6, wherein the display section includes liquid crystal elements.

13. A method of driving a display device, the display device including scanning signals lines, data signals lines being orthogonal to the respective scanning signals, a display section on which pixels corresponding to respective intersections of the scanning signal lines and the data signal lines where the pixels are connected to the scanning signal lines and the data signal lines via switching sections, the method comprising: driving the scanning lines using a scanning signal line drive acquiring a video signal in response to a start pulse using a data signal line drive circuit; outputting the acquired video signal to the data lines in response to a latch pulse using the data signal line drive circuit, the data signal line drive circuit including a plurality of individually-driven circuits, each of the plurality of individually-driven circuit driving an identical number of data signal lines, the plurality of individually-driven circuits being grouped into a first individually-driven circuit group and a second individually-driven circuit group, the first individually-driven group being driven with a first start pulse and a first latch pulse, and the second individually-driven circuit group being driven with a second start pulse and a second latch pulse, each of the first individually-driven circuit group and second individually-driven circuit group controlling acquisition of the video signal from a common data bus, the first individually-driven circuit group being different from the second individually-driven circuit group, the first start pulse being different from the second start pulse, and the first latch pulse being different from the second latch pulse.

14. The method as defined in claim 13, wherein the data signal line drive circuit including the plurality of individually-driven circuits includes terminals for the data signal lines, wherein the total number of the terminals is larger than the number of the data signal lines required for image reproduction on all of the pixels.

15. The method as defined in claim 13, wherein (i) the first start pulse is output, so that the first individually-driven circuit group is caused to sequentially output dummy data and display corresponding to the data signal lines; and (ii) the first start pulse is output, so that a timing of a beginning of output of the dummy data is controlled, in such a manner as to cause a portion of the display data to correspond to initial ones of the pixels.

16. The method as defined in claim 14, wherein (i) the first start pulse is output, so that the first individually-driven circuit group is caused to sequentially output dummy data and display data corresponding to the data signal lines; and (ii) the first start pulse is output, so that a timing of a beginning of output of the dummy data is controlled, in such a manner as to cause a portion of the display data to correspond to initial ones of the pixels.

17. The method as defined in claim 15, wherein the terminals for outputting the dummy data are provided on a left side of a leftmost individually-driven circuit of the display section and on a right side of a rightmost individually-driven circuit of the display section.

18. The method as defined in claim 16, wherein the terminals for outputting the dummy data are provided on a left side of a leftmost individually-driven circuit of the display section and on a right side of a rightmost individually-driven circuit of the display section.

19. The method as defined in claim 17, wherein when the plurality of individually-driven circuits of the data signal line drive circuit acquire data, the video signal is acquired in a direction either from the left side of the leftmost individually-driven circuit to the right side of the rightmost individually-driven circuit or from the right side of the rightmost individually-driven circuit to the left side of the leftmost individually-driven circuit.

20. The method as defined in claim 18, wherein when the plurality of individually-driven circuits of the data signal line drive circuit acquire data, the video signal is acquired in a direction either from the left side of the leftmost individually-driven circuit to the right side of the rightmost individually-driven circuit or from the right side of the rightmost individually-driven circuit to the left side of the leftmost individually-driven circuit.

21. The method as defined in claim 17, wherein when the plurality of individually-driven circuits of the data signal line drive circuit acquire data, a direction of acquiring the video signal is switched between:

a direction from the left side of the leftmost individually-driven circuit to the right side of the rightmost individually-driven circuit; and a direction from the right side of the rightmost individually-driven circuit to the left side of the leftmost individually-driven circuit.

22. The method as defined in claim 18, wherein when the plurality of individually-driven circuits of the data signal line drive circuit acquire data, a direction of acquiring the video signal is switched between:

a direction from the left side of the leftmost individually-driven circuit to the right side of the rightmost individually-driven circuit; and a direction from the right side of the rightmost individually-driven circuit to the left side of the leftmost individually-driven circuit.

23. The method as defined in claim 13, wherein the display section includes liquid crystal elements.

24. The method as defined in claim 14, wherein the display section includes liquid crystal elements.

25. The method as defined in claim 15, wherein the display section includes liquid crystal elements.

26. The method as defined in claim 16, wherein the display section includes liquid crystal elements.

27. The method as defined in claim 17, wherein the display section includes liquid crystal elements.

28. The method as defined in claim 18, wherein the display section includes liquid crystal elements.

29. The method as defined in claim 19, wherein the display section includes-liquid crystal elements.

30. The method as defined in claim 20, wherein the display section includes liquid crystal elements.

31. The method as defined in claim 21, wherein the display section includes liquid crystal elements.

32. The method as defined in claim 22, wherein the display section includes liquid crystal elements

* * * * *